United States Patent [19]

Bade

[11] 4,091,497

[45] May 30, 1978

[54] HANDLE FOR FILES AND SIMILAR TOOLS

[76] Inventor: Walter Bade, Brauck 10, 5805 Breckerfeld, Germany

[21] Appl. No.: 752,118

[22] Filed: Dec. 20, 1976

[51] Int. Cl.[2] ..... B25G 1/00; B25G 1/10

[52] U.S. Cl. ..... 16/110 R; 29/80; 145/61 R

[58] Field of Search ..... 16/110 R, 115; 145/61 R, 61 C, 76, 77; 29/80, 525; 30/136, 147, 148, 149

[56] References Cited

U.S. PATENT DOCUMENTS

| | | | |
|---|---|---|---|
| 91,064 | 1/1869 | Amor | 16/110 R |
| 1,075,732 | 10/1913 | Scott | 29/80 |
| 1,473,186 | 11/1923 | Johnsgaard | 16/115 |
| 1,512,920 | 10/1924 | Galvin | 16/110 R |
| 1,664,257 | 3/1928 | McCullough | 16/110 R |
| 2,056,054 | 9/1936 | Osgood | 29/80 |
| 3,586,080 | 6/1971 | Slany | 145/61 R |

FOREIGN PATENT DOCUMENTS

| | | | |
|---|---|---|---|
| 181,870 | 1/1936 | Switzerland | 29/80 |

*Primary Examiner*—Louis K. Rimrodt
*Attorney, Agent, or Firm*—Marsch & Sparing

[57] ABSTRACT

A handle for files and similar tools having a tang to be pushed into the handle which is a molded integral plastic body provided with an elongated opening to receive the tool tang, the opening having a flat rectangular section shape over most of its length while at its mouth, there is a cylindrical indentation to prevent excessive stress in the handle body.

5 Claims, 3 Drawing Figures

HANDLE FOR FILES AND SIMILAR TOOLS

The present invention relates to a handle for files and similar tools, i.e. tools which are provided with a tang to be pushed into the handle and which are subjected, in use, to forces parallel to the tang axis.

BACKGROUND OF THE INVENTION

It is common practice that files, ratchets and similar tools are manufactured and sold separate from handles for such tools. The file tangs, usually having a triangular configuration, exhibit extreme tolerances even for tools of same type and size. Moreover, it is desired that a handle will be suited for a variety of tool types having different nominal tang dimensions.

In the past, wooden handles were most commonly used. It has also been proposed to use handles made of plastic material, the design of such handles having been quite similar to that of the conventional wooden handles. German utility models Pat. Nos. 72 31 401 and 19 31 900, respectively, disclose such handles. These handles were, however, not successful because of their technical and economical drawbacks.

Technically, the known plastic handles exhibit a tendency to rupture upon the tool tang being driven in because of the extreme radial stresses which occur in particular at the tang bore mouth, the largest dimension of the tang being usually adjacent the very tool body.

Economically, the manufacture of such plastic handles by the conventional injection molding process cannot satisfy. The material being expensive in comparison with wood, the production yield is not competitive either because a relatively great mass of material will need a considerable curing or setting time before a handle may be removed from the mold.

It is the object of the present invention to provide a plastic handle for tools as files or ratchets or the like which may be used for different sizes of tool tangs without the risk of rupture when the tang is driven home, the tool tang remaining nevertheless pressfitted in the handle such that reciprocal forces acting parallel to the tool tang will be transmitted to and from the handle.

In a preferred embodiment of the invention, the handle is provided with indentations extending therein transverse with respect to the tool tang or handle axis, these indentations having the advantage that the mass of handle material is reduced thereby reducing the expenses for the material itself and the time necessary for the material to cure or set in the mold because of the reduced wall thickness.

SUMMARY OF THE INVENTION

Claim 1 of the appended claims defines the features by which the handle in accordance with the invention is believed to distinguish advantageously over the state of the art.

Accordingly, the handle has the conventional elongated shape adapted to the operator's hand. Its plastic body has a bulge rim at the end adjacent the tool, this rim serving to strengthen the handle body and to protect the user whose thumb will, in operation, rest upon the rim. An axial opening to receive the tool tang extends from said first handle end thereinto but terminates within the handle so that the free handle end is closed thereby excluding the danger of a tool tang being pushed through the entire handle.

The section shape of the bore is flat-rectangular with tapering longer sides and the bore may slightly taper inwardly. However, adjacent the handle rim, the bore has a cylindrical section of about the same length as said rim, the diameter of this bore portion being dimensioned such that it corresponds substantially to the largest transverse dimension of the largest tool to be used with this handle. With a flat file, for example, this largest transverse dimension will be the diagonal dimension of the usually flat-rectangular section of the tang. In result, no excessive stresses will occur in the rim portion of the handle where previous plastic handles tended to rupture.

DESCRIPTION OF A PREFERRED EMBODIMENT

A file handle according to the invention is illustrated in the drawing in which

Figure 3:
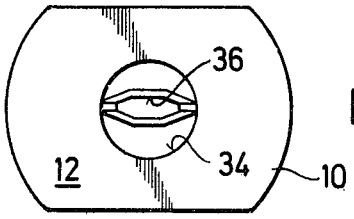
FIG. 3 is a bottom view of the handle.

The handle is an integral body injection molded of a tough plastic material, preferably poly-propylene. The configuration of the handle is adapted to the intended use of the tool. Accordingly, the handle has a bulge rim 10 adjacent its first end 12 adjacent the tool (not shown). From said rim 10, it tapers inwardly and from a portion of minimum diameter 14, it tapers outwardly again to the second end 16. Transversely to the axis 18 of the handle, three series of indentations extend into the handle body.

Figure 2:
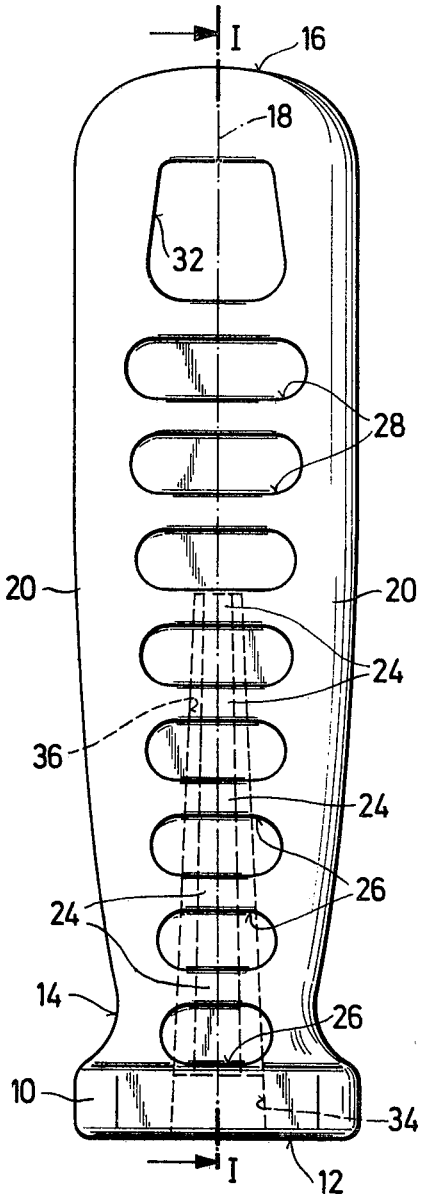
FIG. 2 is a side elevation view of the handle.

The first series of indentations comprises each six substantially oval holes 26 extending from the upper handle face — illustrated in FIG. 2 — and the lower face opposite thereto so that two lateral legs 20 and a central web 22 form, together with transverse walls 24 between adjacent holes 26, a lattice structure. A second series of indentations comprises two holes 28 extending from the upper handle face almost through the entire handle; at the opposite face, the handle has a shallow cavity 30 to be provided with a label or the like. The third series comprises just one bore 32 extending through the entire handle. Bore 32 may serve to hang the handle at a hook or the like.

The section section shape of the handle being exteriorly somewhat elliptic with flattened faces parallel to the longer axis of the ellipse, the user will grip the handle such that the forces act thereupon substantially at said flattened faces where the holes 26, 28 provide a safe contact between handle and hand.

The tool tang will be driven home into an opening extending, from first handle end 12, along the handle axis. The opening comprises a first portion 34 of cylindrical design, the axial length of this portion 34 being substantially equal to that of bulge rim 10. The diameter of the cylindrical portion is adapted to the expected tang dimensions to be received in the bore; the following table is an illustration of dimensions found adequate:

| Axial length of handle (mm) | Diameter of opening portion 34 (mm) |
|---|---|
| 90 | 7,5 |
| 110 | 10 |
| 130 | 14 |

Figure 1:
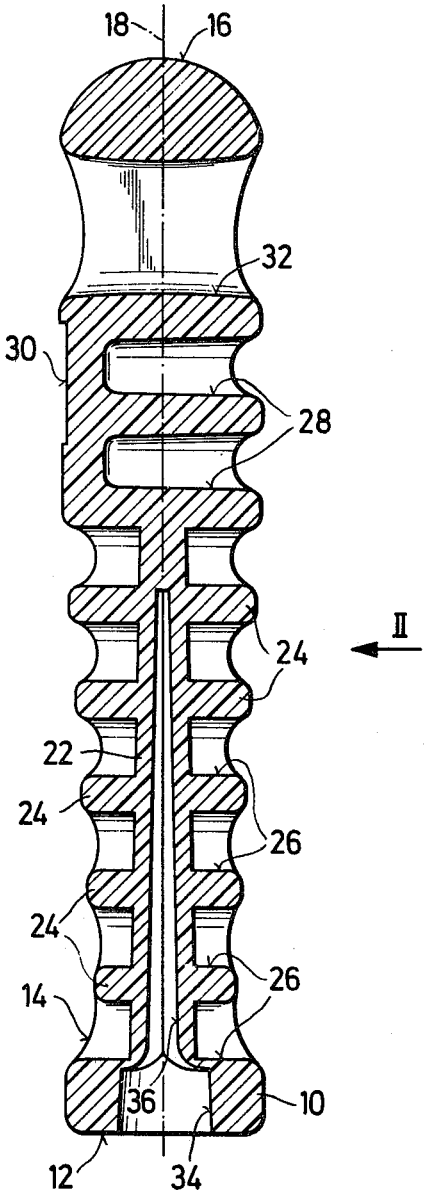
FIG. 1 is an axial section view of the handle.

From the inner end of portion 34, the opening has a substantially flat-rectangular section shape with the narrow ends of the rectangle being extended by small symmetrical triangles such that the section may be regarded as having a modified diamond shape. This fit portion 36 of the opening tapers inwardly in both transverse directions as will be seen in FIGS. 1 and 2. It will further be noted that the opening terminates within web 22 and does not extend beyond holes 28.

It has been found that handle portions adjacent fit portion 36 of the opening will yield when the tool tang is driven home without rupture of the outer skin because there is free space in the area of holes 26. Where the handle must have, for functional reasons, a maximum outer dimension, i.e. at the bulge rim, due to the cylindrical portion 34 of the opening no excessive radial stresses will occur upon driving home of the tool tang and/or during later use of the file.

Modifications may be provided in details of the design, e.g. in the shape, size and disposition of holes 26 and 28, without departing from the spirit of the invention.

What is claimed is:

1. A handle of elongated shape substantially symmetrical with respect to a handle axis for a file, a ratchet or another tool having a tang to be driven axially into said handle and subjected, in use, to reciprocal forces parallel to said axis, the handle being made of a plastic material and being provided with an axial opening to receive said tang, said opening extending, from a first end of the handle, thereinto over less than the entire length thereof, said opening having a substantially flat-rectangular section shape except a first portion adjacent thereof said first handle end where said opening has a circular section of a diameter equal to or greater than the greatest sectional dimension of said tang, the axial length of said first opening portion being substantially equal to the axial extension of a bulge rim provided at said first handle end, the entire handle being integrally molded.

2. A handle as claimed in claim 1 in which indentations are provided extending from the outside of the handle thereinto substantially transverse with respect to said axis.

3. A handle as claimed in claim 2 in which at least some of said indentations extend substantially diametrically through the handle.

4. A handle as claimed in claim 1 in which said opening tapers inwardly from said first handle end.

5. A handle as claimed in claim 1 in which the handle has a substantially elliptic section shape, the greater axis thereof being congruent with a greater axis of said flat-rectangular opening section.

* * * * *